US006207901B1

(12) United States Patent
Smith et al.

(10) Patent No.: US 6,207,901 B1
(45) Date of Patent: Mar. 27, 2001

(54) LOW LOSS THERMAL BLOCK RF CABLE AND METHOD FOR FORMING RF CABLE

(75) Inventors: Andrew D. Smith; Barry R. Allen, both of Redondo Beach, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/285,032

(22) Filed: Apr. 1, 1999

(51) Int. Cl.[7] ..... H01B 7/18

(52) U.S. Cl. ..... 174/102 R; 174/102 SP

(58) Field of Search ..... 174/117 F, 117 FF, 174/36, 21 C, 28, 29, 102 R, 102 SP; 333/12

(56) References Cited

U.S. PATENT DOCUMENTS

| | | | | |
|---|---|---|---|---|
| 3,828,111 | | 8/1974 | Berthet | 174/15 C |
| 3,970,969 | * | 7/1976 | Sirel et al. | 333/12 |
| 4,323,721 | | 4/1982 | Kincaid et al. | 174/36 |
| 4,498,046 | | 2/1985 | Faris et al. | 324/158 F |
| 4,719,319 | | 1/1988 | Tighe, Jr. | 174/103 |
| 4,739,633 | | 4/1988 | Faris | 62/514 R |
| 4,761,517 | | 8/1988 | Massit et al. | 174/36 |
| 4,809,133 | | 2/1989 | Faris et al. | 361/385 |
| 4,845,311 | | 7/1989 | Schreiber et al. | 174/36 |
| 5,120,705 | * | 6/1992 | Davidson et al. | 505/1 |
| 5,138,436 | | 8/1992 | Koepf | 357/74 |
| 5,324,891 | | 6/1994 | Huang et al. | 174/15.4 |
| 5,391,836 | | 2/1995 | Bortas et al. | 174/36 |
| 5,423,110 | | 6/1995 | Gauthier et al. | 29/2 |

OTHER PUBLICATIONS

High–Tc Superconductivity in Satelitte Systems: A Technology Assessment, W Gregorwich, Lockheed Martin Advanced Technology Center, IEEE, Feb 2, 1999.*

* cited by examiner

*Primary Examiner*—Kristine Kincaid
*Assistant Examiner*—William H. Mayo, III
(74) *Attorney, Agent, or Firm*—Michael S. Yatsko

(57) ABSTRACT

An RF cable contains an coaxial inner conductor and a coaxial outer shield surrounding the inner conductor in a concentric arrangement. Quarter-wave series sections in the inner conductor and the outer shield severs a direct thermal path along the RF cable, providing low thermal loading for a cryogenic-to-ambient temperature interconnection. The resonant structure of the RF cable permits propagation alternating current and blocks direct current. A method of forming the RF cable comprises depositing metal on a substrate composed of a polymer film having very low thermal conductivity, and winding the metallized substrate into a tubular configuration. The inner conductor may extend laterally beyond the outer shield to provide points of electrical contact.

14 Claims, 8 Drawing Sheets

LOW LOSS THERMAL BLOCK RF CABLE AND METHOD FOR FORMING RF CABLE

FIELD OF THE INVENTION

The present invention is directed to the field of electromagnetic wave transmission and, more particularly, to a transmission cable for radio frequency (RF) waves.

BACKGROUND ART

In many RF electronic circuit configurations, there is a need to supercool the electronic circuits for improved performance. For example, a thermally cooled amplifier has a lower noise figure than an amplifier operated at ambient temperature. Emerging cryogenic microwave receiver systems that provide enhanced speed and sensitivity include cryogenic cooled components such as cooled mixers and superconductive components for handling signals. These systems place difficult demands on signal connections. The connections to these systems include one end typically at ambient temperature, and an opposite end at a cryogenic temperature. It is highly advantageous to reduce heat conduction along the RF coaxial signal connections to maintain the receiver components at the cryogenic temperature without placing excessive demands on the receiver system refrigeration unit, which commonly has limited cooling capabilities. Input and output via the connections is difficult because the connections need to present minimal thermal load while simultaneously minimizing transmission loss to the input and output signals. The efficiency and power dissipation in the refrigeration units is determined by the refrigeration power supply. The lower the heat load imposed by RF connections, the lower the temperature the refrigeration unit can cool the amplifier, producing a lower overall amplifier noise figure. Consequently, it is important to reduce the heat leakage along RF connections to the cryogenic system.

The problem of providing an input/output RF connection is fundamentally challenging because all materials having high electrical conductivity also have high thermal conductivity. No existing coaxial RF connection solves this problem.

In addition, connections for such cryogenic systems should have low insertion loss, which is a measure of transmission efficiency. Low insertion loss relates to reduced power loss during transmission.

Thus, there is a need for an improved RF connection that has (i) very low thermal conductivity, and (ii) low insertion loss over a range of frequencies.

SUMMARY OF THE INVENTION

The present invention provides an improved RF cable that has (i) very low thermal conductivity, and (ii) low insertion loss over a wide band of frequencies. The RF cable can transmit RF waves such as microwaves at modest currents between points at widely varying temperatures, such as between ambient and cryogenic temperatures. The RF cable transmits RF waves over a band which encompasses more than an octave in the frequency spectrum. The RF waves are typically microwaves, but can be other RF waves as well.

The RF cable comprises a coaxial inner conductor and a coaxial outer shield surrounding the inner conductor in a concentric configuration. The inner conductor can include a first inner conductor section, a second inner conductor section axially spaced from the first inner conductor section, and a third inner conductor section. The third inner conductor section has a length of about $\lambda$ and includes opposed end portions each having a length of about $n\lambda/4$, where n is typically equal to one. One end portion coextends with the first inner conductor section at a break, and the other end portion coextends with the second inner conductor section at another break. The breaks are quarter-wave series sections. The inner conductor sections form a discontinuous axial thermal flow path along the inner conductor. The inner conductor sections are comprised of a highly electrically conductive material to achieve low electrical losses. A dielectric material can be provided between the end portions of the third inner conductor section and each of the first and second inner conductor sections.

The outer shield can include a first outer shield section, a second outer shield section axially spaced from the first outer shield section, and a third outer shield section. The third outer shield section has a length of preferably about $\lambda/2$ and includes opposed end portions each having a length of preferably about $\lambda/4$. One end portion coextends with the first outer shield section at a break, and the other end portion coextends with the second outer shield section at another break, thereby forming a discontinuous thermal flow path along the outer shield. The first, second and third outer shield sections are comprised of a highly electrically conductive material. A dielectric material can be provided between the end portions of the third outer shield section and each of the first and second outer shield sections.

The RF cable includes at least one break in each of the inner conductor and the outer shield. The breaks prevent the direct flow of heat along the inner conductor and the outer shield, and enable resonant transmission and good electrical conductance.

The RF cable can include, for example, a single break in each of the inner conductor and the outer shield. In this construction, the coaxial inner conductor comprises a first inner conductor section and a second inner conductor section, coextending over a length of preferably about $\lambda/4$. The coaxial outer shield comprises a first outer shield section and a second outer shield section, also coextending over a length of preferably about $\lambda/4$.

The RF cable can comprise means for maintaining the inner conductor and the outer shield in a substantially fixed configuration. For example, an electrical connector can be provided at the input and output ends. Dielectric material with low thermal conductance can be used to position the concentric conductance. The interior of the RF cable can be maintained at a low selected pressure to provide very low thermal conductance.

The RF cable can have a spiral configuration. The spiral configuration can be formed by depositing a highly electrically conductive material, typically a metal, onto a substrate having very low thermal conductivity, such as a dielectric material sheet. The substrate is wound in a spiral configuration, typically around a form having very low thermal conductivity, to form the spiral configuration. Breaks in the inner conductor and the outer shield form a discontinuous axial thermal flow path along the RF cable. The spiral configuration includes exposed end regions of the metal that enable direct electrical contact to the RF cable.

BRIEF DESCRIPTION OF THE DRAWINGS

These and other features, aspects and advantages of the present invention will become better understood from the following description, appended claims and accompanying drawings, where:

DETAILED DESCRIPTION OF THE PREFERRED EMBODIMENTS

Figure 1:
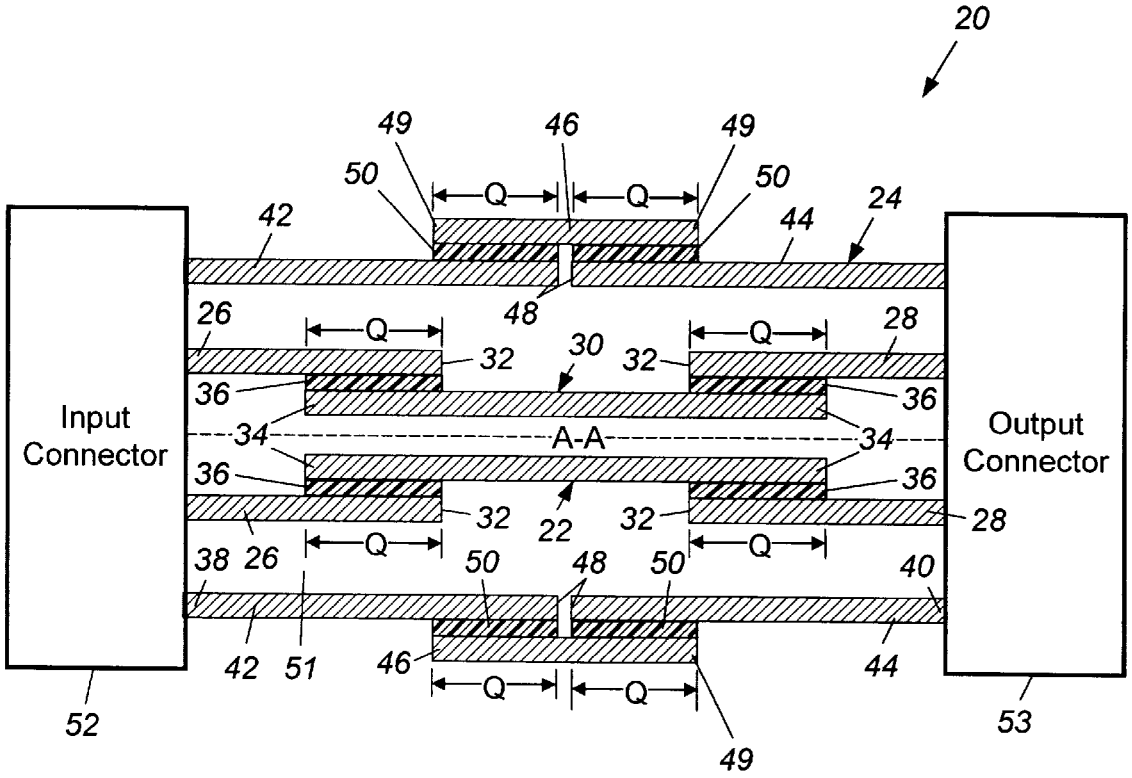
FIG. 1 is a longitudinal cross-sectional view of a double-break RF cable in accordance with the invention.

FIG. 1 illustrates an RF cable 20 in accordance with the invention. The RF cable 20 comprises an inner conductor 22 and an outer shield (current return) 24 surrounding the inner conductor 22 in a concentric, coax within a coax arrangement. The RF cable 20 defines a longitudinal axis A—A.

The inner conductor 22 comprises a first inner conductor section 26, a second inner conductor section 28 axially spaced from the first inner conductor section 26, and a third inner conductor section 30 partially within each of the first and second inner conductor sections in a coaxial configuration. As shown, the first and second inner conductor sections 26, 28 can be tubular shaped and of substantially the same diameter. The third inner conductor section 30 is also tubular shaped and has a smaller diameter than the first and second inner conductor sections 26, 28. The inner conductor sections 26, 28 are preferably parallel to each other. Breaks 32 prevent direct axial heat flow along the entire length of the inner conductor 22.

The inner conductor sections 26, 28, 30 are formed of an electrically conductive material to reduce RF losses. The material can be a metal such as copper, aluminum, gold, silver and the like.

The inner conductor sections 26, 28, 30 typically have a thickness equal to at least about 3–4 skin depths to enable sufficient electrical current flow along the inner conductor 22. The skin depth is related to the electrical conductivity of the material and to the RF frequency. For example, the skin depth of copper at a microwave frequency of about 10 GHz is about 1 micron.

A dielectric material 36 can be provided between the first and second inner conductor sections 26, 28 and the third inner conductor section 30 at opposed end portions 34 of the third inner conductor section. The dielectric material 36 has low thermal conductivity so that heat flow from the first inner conductor section 26 to the third inner conductor section 30, and from the third inner conductor section 30 to the second inner conductor section 28 is low. The dielectric material 36 can be, for example, "MYLAR," a polystyrene polymer.

The outer shield 24 can comprise a first outer shield section 42, a second outer shield section 44 axially spaced from the first outer shield section 42, and a third outer shield section 46 partially surrounding each of the first and second outer shield sections 42, 44 in a coaxial configuration. The first and second outer shield sections 42, 44 are typically tubular shaped and of substantially the same diameter. The third outer shield section 46 is typically tubular shaped and has a greater diameter than the first and second outer shield sections 42, 44. The outer shield sections 42, 44, 46 are preferably parallel to each other. Breaks 48 prevent direct axial heat flow along the outer shield 24.

A dielectric material 50 can be provided between the first and second outer shield sections 42, 44 and the third outer shield section 46 at opposed ends 49 of the third outer shield section. The dielectric material 50 reduces heat flow from the first outer shield section 42 to the third outer shield section 46, and from the third outer shield section 46 to the second outer shield section 44.

The interior space 51 of the RF cable 20 can be filled with a dielectric material (not shown). The dielectric material contributes to the low thermal conductivity of the RF cable 20. Alternately, the interior space 51 can be maintained at a vacuum pressure or filled with a gas such as air at an elevated pressure.

The input end 38 and the output end 40 of the RF cable 20 can be closed using respective electrical connectors 52, 53 to provide mechanical support and maintain the inner conductor 22 and the outer shield 24 in relative alignment, and to provide a gas seal to maintain the selected pressure within the interior space 51. For example, the connectors 52, 53 can be SMA-type connectors.

The RF cable 20 can be used for RF transmission at modest currents. For example, weak signals from an antenna are typically at the microwatt level and at a peak current of about 0.2 mA. The RF cable 20 can be used for transmission to a system including electronic circuits at a low temperature, such as a cryogenically-cooled microwave receiver system (not shown). The input end 38 of the RF cable 20 can be at a temperature of about 300K, and the output end 40 at a cryogenic temperature up to about 80K. The cryogenic refrigeration systems conventionally used in microwave receiver systems have low cooling capacity. Accordingly, it is important to reduce heat conduction into the system. The efficiency and power dissipation of the refrigeration system is determined by the system's refrigeration power supply. The RF cable 20 reduces RF input thermal power to the refrigeration system, enabling the refrigeration system to cool an associated amplifier to a lower temperature to produce a lower overall amplifier noise figure. The RF cable 20 is particularly suitable for front end receiver and low noise RF applications.

The RF cable 20 blocks direct current (d.c.) flow because the breaks 32, 48 in the inner conductor 22 and the outer shield 24, respectively, form an axially discontinuous electric charge flow path. Alternating current (a.c.) can flow along the entire length of the RF cable 20 due to the relative positioning of the inner conductor 22 and the outer shield 24. More specifically, the inner conductor 22 and the outer shield 24 form sections Q each of a length of about $n\lambda/4$, where $\lambda$ is a wavelength within the range of RF wavelengths transmitted along the RF cable 20, and n is an odd integer of at least one. The sections Q preferably have a length of about a quarter wave ($\lambda/4$), and are referred to herein as "quarter-wave series sections". The quarter-wave series sections maintain a low insertion loss over a wider RF wave frequency range than longer section lengths such as $3\lambda/4$ and $5\lambda/4$. The third inner conductor section 30 has a length of preferably about $\lambda$, and the third outer shield section 46 has a length of preferably about $\lambda/2$. The inner conductor 22 and the outer shield 24 can each have an arbitrary total axial length. The RF flow is under resonant conditions due to the presence of the quarter-wave series sections Q. The RF cable 20 characteristic impedence can be matched with the characteristic impedence of the RF input transmission line to the RF cable 20. Accordingly, the RF cable 20 has good electrical conductance, despite the presence of the breaks 32, 48.

The RF cable 20 has very low thermal conductivity. Particularly, the RF cable 20 has an estimated thermal load of only about 10 mW from a direct multi-watt coaxial RF connection, at an input end 38 temperature of about 300K and an output end 40 temperature of about 80K. This advantage is achieved by the breaks 32, 48 and the low thermal conductivity of the dielectric material 36, 50.

Figure 2:
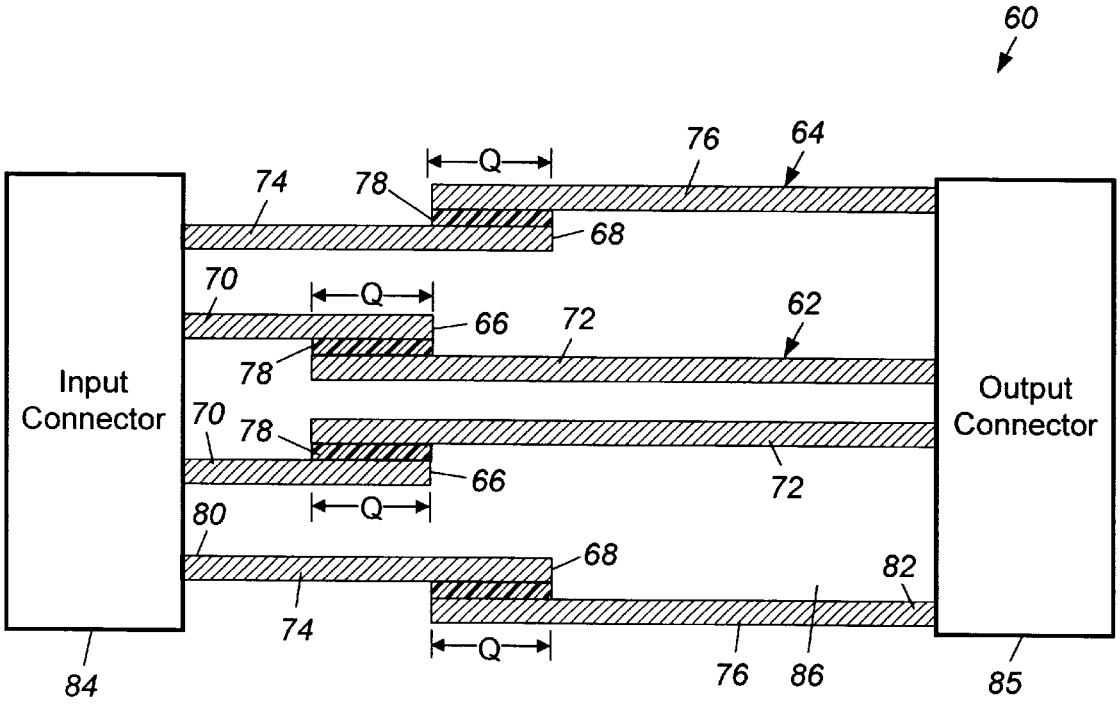
FIG. 2 is a longitudinal cross-sectional view of a single-break RF cable in accordance with the invention.

As shown in FIG. 2, an alternative RF cable 60 in accordance with the invention comprises a coaxial inner conductor 62 and a coaxial outer shield 64, with only a single break 66 in the inner conductor 62 and only a single break 68 in the outer shield 64. The inner conductor 62 comprises a first inner conductor section 70 and a second inner conductor section 72 partially inside the first inner conductor section 70. The inner conductor sections coextend over a length Q, which is preferably about $\lambda/4$. The second inner conductor section 72 has a length of preferably at least about $\lambda/2$. The outer shield 64 comprises a first outer shield section 74 which is partially surrounded by a second outer shield section 76. The first and second outer shield sections 74, 76 coextend over a length Q, which is preferably about $\lambda/4$. The inner conductor sections 70, 72 and the outer shield sections 74, 76 are preferably substantially parallel to each other.

A dielectric material 78 having low thermal conductivity can be provided between the first and second inner conductor sections 70, 72, and between the first and second outer shield sections 74, 76, to reduce heat flow.

The RF cable 60 has an input end 80 and an output end 82. Input and output connectors 84, 85 can be provided at the input end 80 and the output end 82, respectively, to maintain a substantially fixed configuration of the inner conductors 62 and the outer shield 64, and to maintain a selected pressure within the interior space 86 of the RF cable 60. For example, the selected pressure can be maintained within the inner conductor 62. The connectors 84, 85 can each be, for example, an SMA-type connector.

The quarter-wave series sections Q enable the transmission of RF waves under resonant conditions, and also enable good electrical conductance of the RF cable 60. The breaks 66, 68 enable low thermal conductivity of the RF cable 60.

Figure 3:
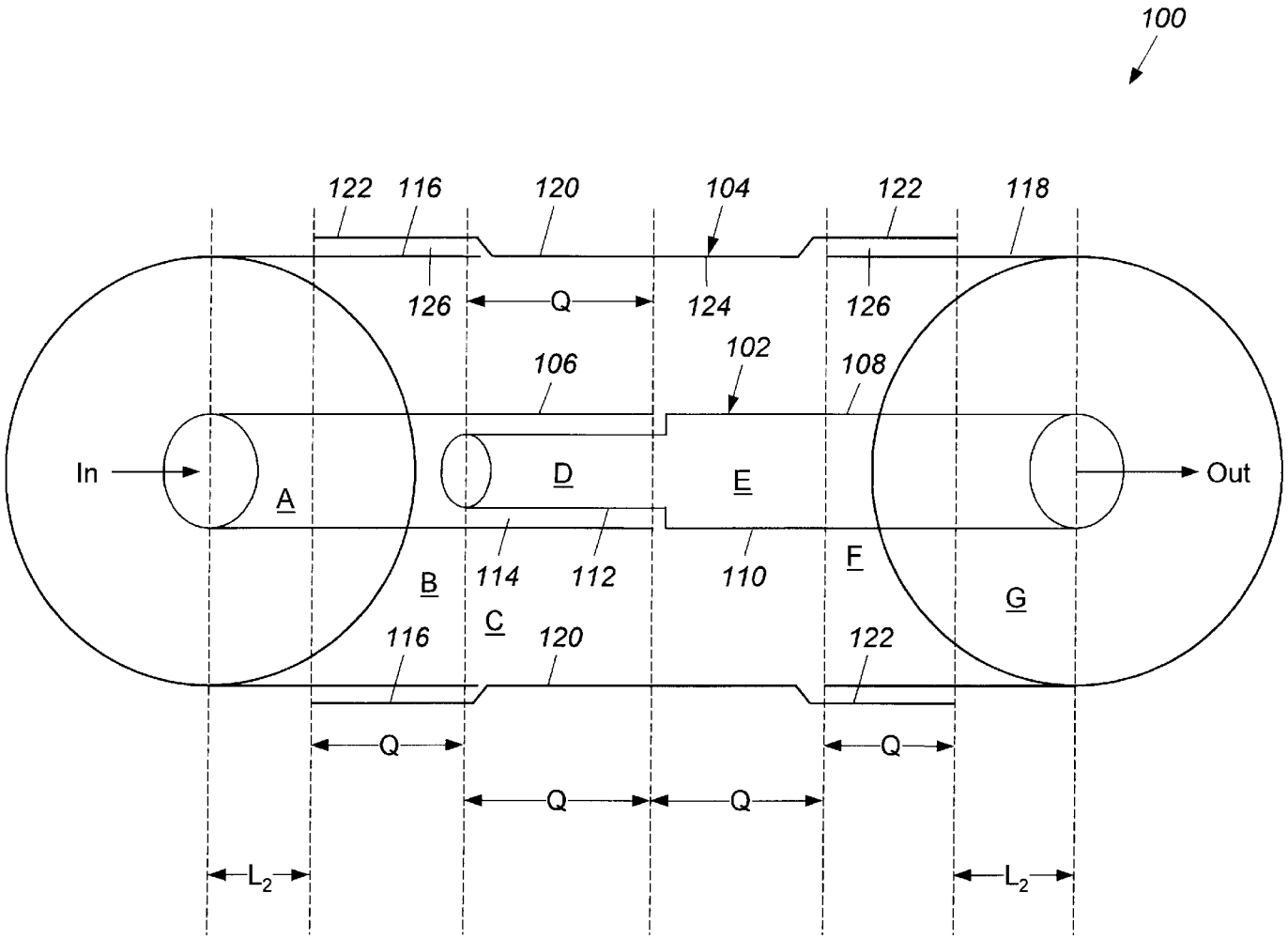
FIG. 3 illustrates an RF cable in accordance with the invention having a single break in the inner conductor and two breaks in the outer shield.

An alternative RF cable 100 in accordance with the invention is shown in FIG. 3. The RF cable 100 comprises a coaxial inner conductor 102 and a coaxial outer shield 104. The inner conductor 102 includes a first inner conductor section 106 and a second inner conductor section 108. The second inner conductor section 108 includes a first portion 110 preferably having about the same diameter as the first inner conductor section 106, and a second portion 112 having a smaller diameter than the first portion 110. The second portion 112 is inside of and coextends with the first inner conductor section 106 over a length Q preferably equal to about $\lambda/4$, such that the section 114 is a quarter-wave series section. The lengths $L_1$ and $L_2$ of the first and second inner conductor sections 106, 108, respectively, are arbitrary.

The outer shield 104 includes a first outer shield section 116, a second outer shield section 118 and a third outer shield section 120. The first and second outer shield sections 116, 118 preferably have about the same diameter. The third outer shield section 120 includes end portions 122 each having a diameter greater than the diameter of the first and second outer shield sections 116, 118, and an intermediate portion 124 having about the same diameter as the first and second outer shield sections 116, 118. The end portions 122 surround and coextend with the respective first and second outer shield sections 116, 118, over a length Q preferably equal to about $\lambda/4$, such that the sections 126 are quarter-wave series sections. Thus, the RF cable 100 includes a single break in the inner conductor 102 and two breaks in the outer shield 104.

Figure 4:
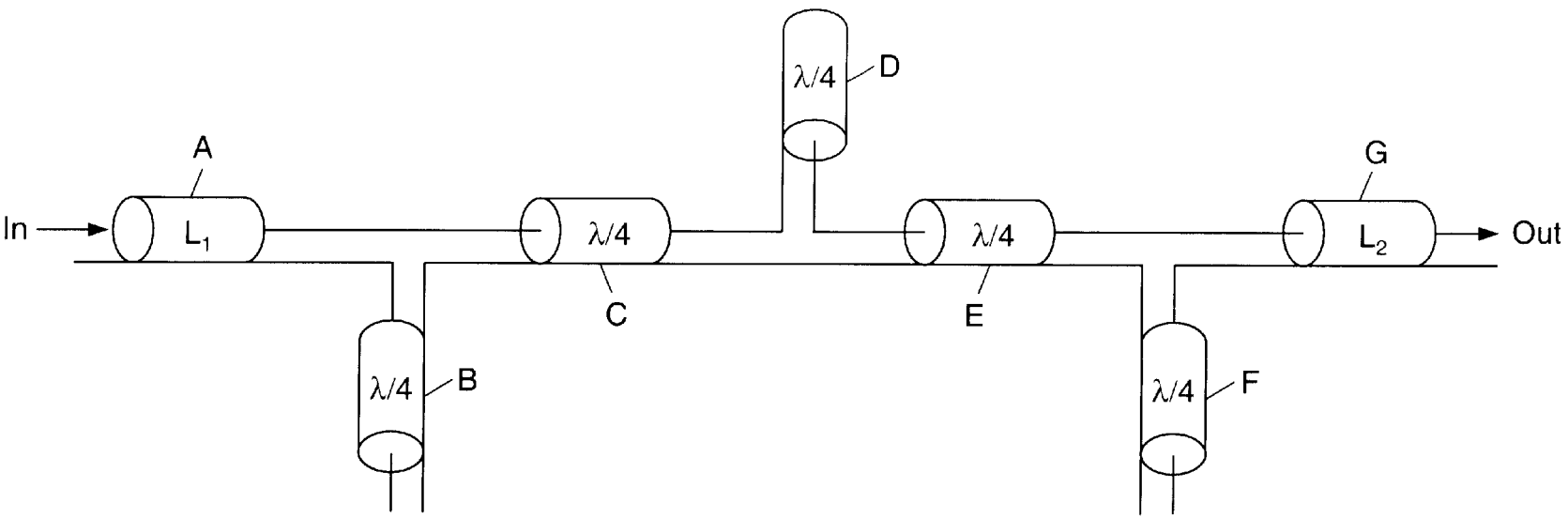
FIG. 4 is an RF schematic illustration of the RF cable of FIG. 3.

FIG. 4 is an RF schematic of the RF cable 100 of FIG. 3. The different regions A–G as referenced in FIG. 3 are depicted. The regions A and G have lengths of $L_1$ and $L_2$, respectively, and the regions B–F each have a length of about $\lambda/4$.

Figure 5:
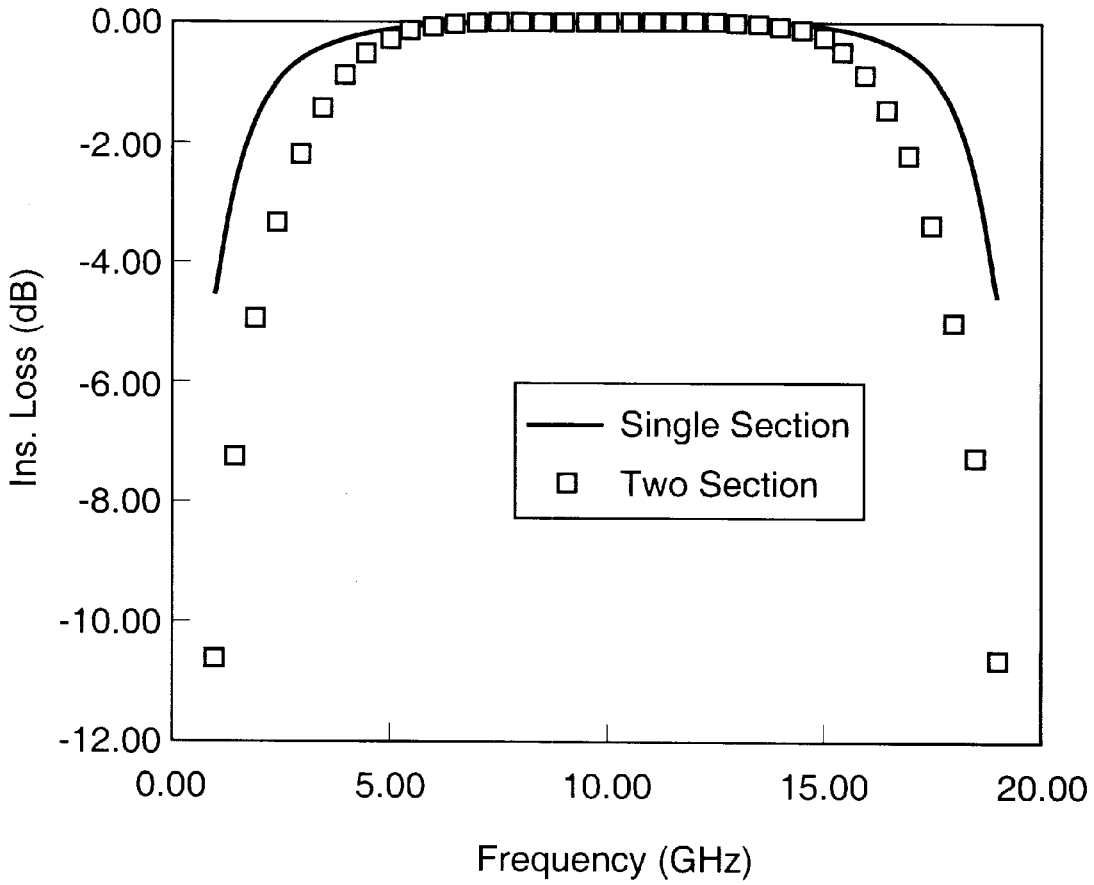
FIG. 5 shows the calculated insertion loss versus the electromagnetic wave frequency for single and double-break RF cables in accordance with the invention.

The insertion loss of the RF cables 20 and 60 is predicted to be very low over a relatively wide band of electromagnetic wave frequencies. The insertion loss is an indication of the transmission efficiency and can be defined as follows:

$$\text{insertion loss}=10\log_{10}(P_{out}/P_{in})$$

where insertion loss is given in decibels (dB), $P_{out}$ is the power at the output end of the RF cable, and $P_{in}$ is the power at the input end. An insertion loss of zero represents no loss of power. FIG. 5 shows the calculated insertion loss, over the frequency range of 0–20 GHz, of the double-break RF cable 20 and the single-break RF cable 60, having quarter-wave series sections of a length equal to about $\lambda/4$ at 10 GHz. At 10 GHz, the RF cables 20, 60 operate at about perfect resonance. The insertion loss is only about −0.2 dB at 10 GHz, and about this very low value over the frequency range of from about 5 GHz to about 15 GHz. Overall, the single-break RF cable 60 and double-break RF cable 20 have comparable insertion loss characteristics. The frequency range over which the insertion loss is near zero generally increases as the number of breaks in the RF cable is increased.

Thus, the RF cable according to the present invention provides the advantages of very low thermal conductivity, good electrical conductance, and low insertion loss over a wide frequency band.

Figure 6:
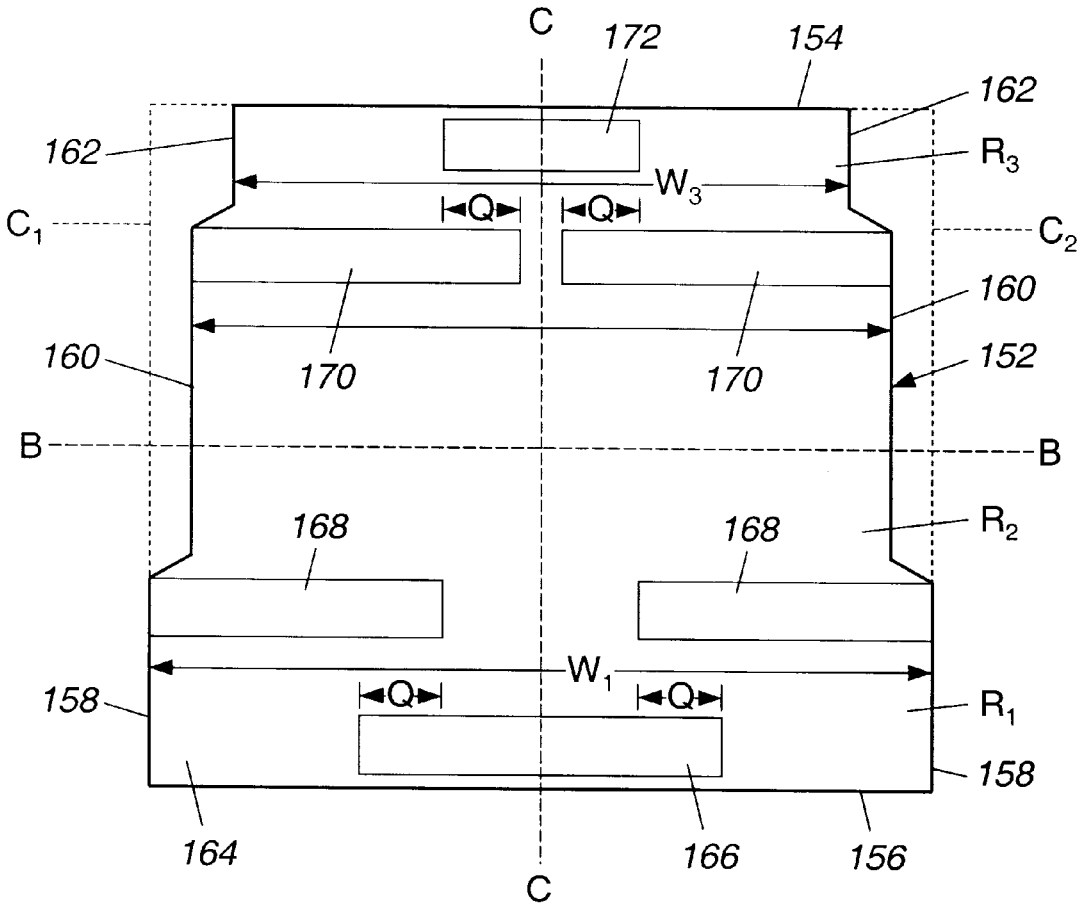
FIG. 6 is a top plan view of a metallized substrate prior to winding the substrate to form a spiral-shaped RF cable in accordance with the invention.
Figure 7:
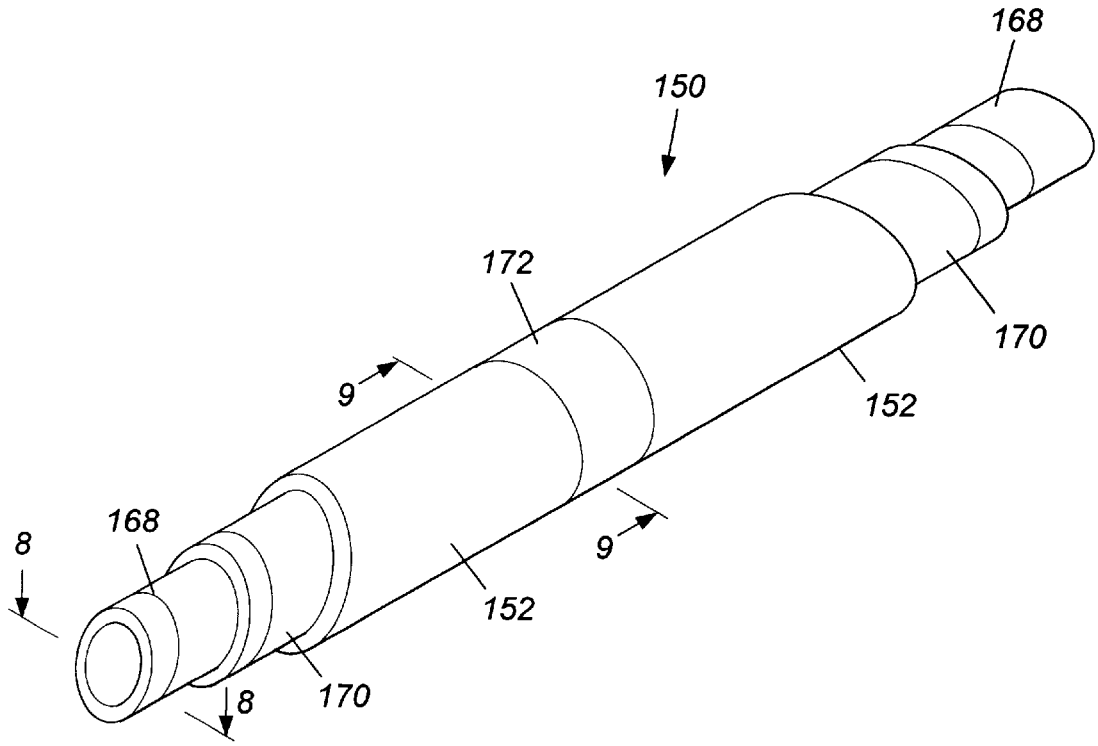
FIG. 7 is a perspective view of the spiral-shaped RF cable.

FIG. 7 illustrates a double-break RF cable 150 according to the invention having a spiral configuration. Referring to FIG. 6, the RF cable 150 can be formed by metallizing selected portions of a substrate 152 composed of a material having a low coefficient of thermal conductivity. Suitable materials for forming the substrate 152 include "MYLAR" and like polymer dielectric materials. The substrate 152 has a top edge 154 and a bottom edge 156, and comprises regions $R_1$, $R_2$ and $R_3$, having respective side edges 158, 160, 162, and respective widths $W_1$, $W_2$ and $W_3$. The illustrated configuration of the substrate 152 can be formed by cutting the regions $C_1$ and $C_2$ from a rectangular shaped substrate. The substrate 152 has an axial center line B—B and a transverse center line C—C. The substrate 152 can have a typical thickness of from about 0.25 mil to about 1 mil. Reducing the substrate 152 thickness reduces thermal conduction along the RF cable 150.

A material having high electrical conductivity to reduce electrical losses is deposited on the surface 164 of the substrate 152 in the form of strips. The material can be a metal such as copper, aluminum, gold, silver and the like. The metal is applied at the regions 166, 168, 170 and 172 of the substrate 152. The applied metal preferably has a thickness of at least 3–4 skin thicknesses.

The metal can be deposited on the substrate 152 by a conventional thin film deposition process such as chemical vapor deposition. The metal can be patterned using a conventional photoresist mask formed on the substrate 152.

The metal is applied at selected areas of the surface 164 of the substrate 152. A first metallic strip 166 of a length of preferably about λ is formed near the bottom edge 156 of the substrate 152. A pair of laterally spaced, second metallic strips 168 are also formed at the region $R_1$ and transversely spaced from the first metallic strip 166. The second metallic strips 168 are axially spaced and axially aligned with respect to each other. The second metallic strips 168 each coextend with the first metallic strip 166 along a length Q equal to preferably about λ/4. A pair of laterally spaced, third metallic strips 170 are formed at the region $R_2$. A fourth metallic strip 172 of a length of preferably about λ/2 is formed at the region $R_3$. The third metallic strips 170 each coextend with the fourth metallic strip 172 over a length Q equal to preferably about λ/4. The metallic strips are preferably parallel to each other on the substrate.

The RF cable 150 is formed by winding the metallized substrate 152 in the transverse direction C—C, beginning at the bottom edge 156 of the substrate 152. The substrate 152 can be wound, for example, around a suitable form such as a glass rod (not shown) comprised of a low thermal conductivity material. The form can be removed after the RF cable 150 is formed or optionally left inside the RF cable 150. The RF cable 150 has a continuous, spiral configuration. The second metallic strips 168 extend furthest laterally at both ends of the RF cable 150, thereby providing electrical connection points.

Figure 8:
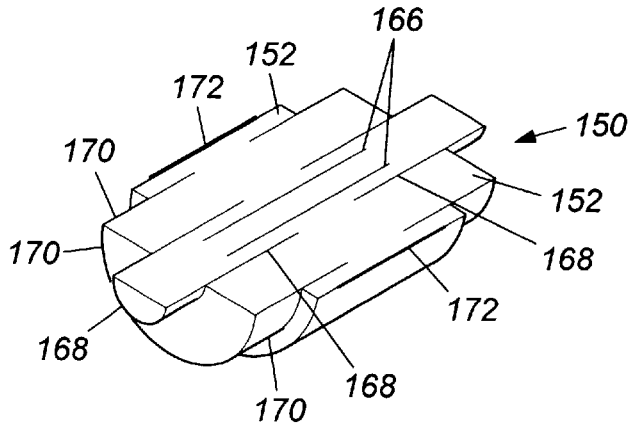
FIG. 8 is an axial cross-section in the direction of line 8—8 of FIG. 7.

FIG. 8 illustrates an axial cross-section of the RF cable 150.

Figure 9:
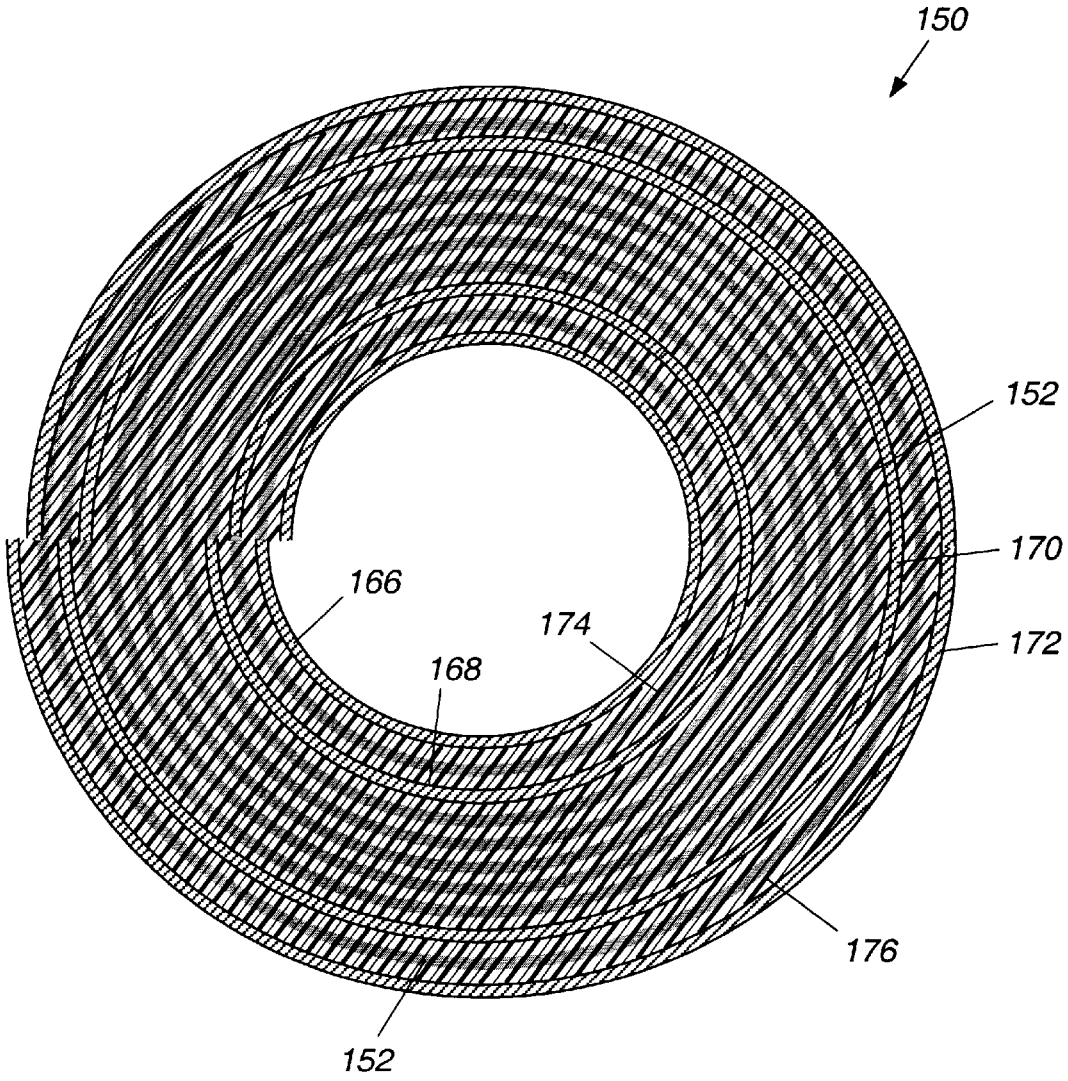
FIG. 9 is a transverse cross-section in the direction of line 9—9 of FIG. 7.

FIG. 9 shows a transverse cross-section of the RF cable 150. As shown, the metallic strips 166, 168, 170 and 172 each have a spiral cross-sectional configuration and are concentrically positioned relative to each other in a coax within a coax configuration. The first metallic strip 166 and the second metallic strips 168 are separated from each other by the substrate 152 to form the inner conductor 174. The third metallic strips 170 are separated from the second metallic strips 168 by the substrate 152. The fourth metallic strip 172 is separated from the third metallic strips 170 by the substrate 152 to form the outer shield 176.

The predicted thermal conductivity of the RF cable 150 is very low due to the thinness of the metallic strips 166, 168, 170, 172, and to the thinness and low thermal conductivity of the substrate 152.

Although the present invention is described in considerable detail with reference to certain preferred embodiments thereof, other embodiments are possible. In particular, the number of coaxial coupled sections are not limited. The number of quarter-wave series sections in the inner and outer coaxial conductors can be increased to provide more bandwidth. Therefore, the scope of the appended claims is not limited to the description of the preferred embodiments contained herein.

What is claimed is:

1. An RF cable for transmitting RF waves over a band of wavelengths which encompasses a wavelength λ, the RF cable comprising:

a) a coaxial inner conductor including:

i) a first inner conductor section;

ii) a second inner conductor section laterally spaced from the first inner conductor section;

iii) a third inner conductor section including opposed end portions, one of said end portions being transversely spaced from, and coextending over a length of about λ/4 with, the first inner conductor section, and the other of said end portions transversely spaced from, and coextending over a length of about λ/4 with, the second inner conductor section, thereby forming a discontinuous thermal flow path along the inner conductor; and iv) a dielectric material between the end portions of the third inner conductor section and each of the first and second inner conductor sections;

wherein the first, second and third inner conductor sections are composed of an electrically conductive material; and b) a coaxial outer shield surrounding the inner conductor, the outer shield including:

i) a first outer shield section;

ii) a second outer shield section laterally spaced from the first outer shield section;

iii) a third outer shield section including opposed end portions, one of said end portions of the third outer shield section being spaced from, and coextending over a length of about λ/4 with, the first outer shield section, and the other of said end portions being spaced from, and coextending over a length of about λ/4 with, the second outer shield section, thereby forming a discontinuous thermal flow path along the outer shield; and iv) a dielectric material between the end portions of the third outer shield section and each of the first and second outer shield sections;

wherein the first, second and third outer shield sections are composed of an electrically conductive material.

2. The RF cable of claim 1, having an insertion loss of about −0.2 dB at an RF wave frequency of about 5 GHz to about 15 GHz.

3. The RF cable of claim 1, wherein the inner conductor and the outer shield each have an input end and an output end, the RF cable having a thermal load of about 10 mW at an input end temperature of about 300K and an output end temperature of about 77K.

4. The RF cable of claim 1, wherein the third inner conductor section has a length of about λ, and the third outer shield section has a length of about λ/2.

5. The RF cable of claim 1, wherein the first, second and third inner conductor sections and the first, second and third outer shield sections each have a thickness equal to at least about 3–4 skin thicknesses of the thermally conductive material.

6. The RF cable of claim 1, further comprising means for maintaining the inner conductor and the outer shield in a substantially fixed configuration.

7. The RF cable of claim 1, comprising an input end, an output end, and a connector disposed at each of the input end and the output end.

8. The RF cable of claim 1, wherein the first inner conductor section includes exposed portions at opposed lateral ends of the RF cable for electrical connection to the RF cable.

9. An RF cable for transmitting RF waves over a band of wavelengths which encompasses a wavelength λ, the RF cable having an input end, an output end and a longitudinal axis, the RF cable comprising:

a) a coaxial inner conductor including:

i) a metallic first inner conductor section;

ii) a metallic second inner conductor section axially spaced from the first inner conductor section; and iii) a metallic third inner conductor section having a length of about λ and including opposed end portions, one of said end portions being radially spaced from, and coextending over an axial length of about λ/4, with the first inner conductor section, and the other of said end portions being radially spaced from, and coextending over an axial length of about λ/4 with, the second inner conductor section, thereby forming a discontinuous axial thermal flow path along the inner conductor; and iv) a dielectric material between said end portions of the third inner conductor section and each of said first inner conductor section and said second inner conductor section; and b) a coaxial outer shield surrounding the inner conductor in a concentric configuration, the outer shield including:

i) a metallic first outer shield section; ii) a metallic second outer shield section axially spaced from the first outer shield section;

iii) a metallic third outer shield section having a length of about λ/2 and including opposed end portions, one of said end portions of the third outer shield section being radially spaced from, and coextending over an axial length of about λ/4 with, the first outer shield section, and the other of said end portions of said third outer shield section being radially spaced from, and coextending over an axial length of about λ/4 with, the second outer shield section, thereby forming a discontinuous axial thermal flow path along the outer shield;

iv) a dielectric material between the end portions of the third outer shield section and each of the first outer shield section and the second outer shield section, respectively; and c) means for maintaining the inner conductor and the outer shield in a substantially fixed configuration;

wherein (i) the inner conductor and the outer shield each have an input end and an output end, the RF cable having a thermal load of about 10 mW at an input end temperature of about 300K and an output end temperature of about 77K; and (ii) the RF cable having an insertion loss of about −0.2 dB at an RF wave frequency of about 5 GHz to about 15 GHz.

10. The RF cable of claim 9, wherein the first, second and third inner conductor sections and the first, second and third outer shield sections each have a thickness equal to at least about 3–4 skin thicknesses of the metallic material.

11. The RF cable of claim 9, wherein the first inner conductor section includes exposed electrical connection portions at opposed ends of the RF cable.

12. An RF cable for transmitting RF waves over a band of wavelengths which encompasses a wavelength λ, the RF cable having a longitudinal axis and comprising:

a) a coaxial inner conductor including:

i) an electrically conductive first inner conductor section having a diameter; and ii) an electrically conductive second inner conductor section having a first portion having about the diameter of the first inner conductor section and a second portion having a smaller diameter than the first portion, the second portion being radially spaced from and coextending over a length of about λ/4 with, the first inner conductor section, thereby forming a discontinuous thermal flow path along the inner conductor; and b) a coaxial outer shield surrounding the inner conductor, the outer shield including:

i) an electrically conductive first outer shield section having a diameter;

ii) an electrically conductive second outer shield section axially spaced from the first outer shield section and having about the same diameter as the first outer shield section; and iii) an electrically conductive third outer shield section including opposed end portions and an intermediate portion, the end portions each having a larger diameter than the intermediate portion and the intermediate portion having about the same diameter as the first and second outer shield sections, one end portion being radially spaced from, and coextending over a length of about λ/4 with, the first outer shield section, and the other end portion being radially spaced from, and coextending over a length of about λ/4 with, the second outer shield section, thereby forming a discontinuous thermal flow path along the outer shield.

13. A method of forming an RF cable for transmitting RF waves over a range of wavelengths which encompasses a wavelength λ, the method comprising the steps of:

a) providing a substrate having a top edge, a bottom edge opposed side edges, and a face, the substrate being comprised of an electric insulator;

b) forming a strip pattern of an electrically conductive material on the face of the substrate, the strip pattern including:

i) a first strip;

ii) a pair of second strips spaced from the first strip in a transverse direction which extends from the bottom edge toward the top edge of the substrate, the second strips being substantially aligned with each other in a longitudinal direction;

iii) a pair of third strips spaced from the second strips in the transverse direction, the second strips being substantially aligned with each other in the longitudinal direction; and iv) a fourth strip spaced from the third strips in the transverse direction;

wherein the first, second, third and fourth strips are substantially parallel to each other; and c) winding the substrate in the transverse direction to form the RF cable having a spiral configuration and defining a longitudinal axis, the RF cable comprising:

i) a coaxial inner conductor including:

1) the first strip having a spiral configuration and including opposed end portions;

2) the second strips radially spaced from the first strip, each second strip having a spiral configuration, the second strips each including an end portion having, the end portions of the second strips each coextending with one of the end portions of the first strip over a length of about λ/4, thereby forming a discontinuous thermal flow path along the inner conductor;

ii) a coaxial outer shield surrounding the inner conductor in a concentric configuration, the outer shield including:

1) the third strips radially spaced from the second strips, each third strip having a spiral configuration, the third strips each including an end portion;

2) the fourth strip radially spaced from the third strips, the fourth strip including opposed end portions, the end portions of the fourth strip each coextending with an end portion of one of the third strips over a length of about λ/4, thereby forming a discontinuous thermal flow path along the outer shield.

14. The method of claim 13, wherein the inner conductor includes exposed portions at opposed lateral ends of the RF cable for electrical connection to the RF cable.

* * * * *